US010008347B1

(12) United States Patent
Weinreich

(10) Patent No.: US 10,008,347 B1
(45) Date of Patent: Jun. 26, 2018

(54) ELECTRICAL SWITCH WITH BUILT IN FUSE IMPROVEMENT

(71) Applicant: Palle Kohring Weinreich, Ceiba, PR (US)

(72) Inventor: Palle Kohring Weinreich, Ceiba, PR (US)

( * ) Notice: Subject to any disclaimer, the term of this patent is extended or adjusted under 35 U.S.C. 154(b) by 0 days. days.

(21) Appl. No.: 15/042,412

(22) Filed: Feb. 12, 2016

Related U.S. Application Data

(63) Continuation-in-part of application No. 13/961,930, filed on Aug. 8, 2013, now Pat. No. 9,263,211.

(51) Int. Cl.
*H01H 21/16* (2006.01)
*H01H 21/22* (2006.01)
*H01H 21/12* (2006.01)

(52) U.S. Cl.
CPC ..... *H01H 21/16* (2013.01); *H01H 21/12* (2013.01); *H01H 21/165* (2013.01); *H01H 21/22* (2013.01); *H01H 2235/01* (2013.01)

(58) Field of Classification Search
CPC ..... H01H 21/16; H01H 21/165; H01H 21/12; H01H 21/22; H01H 2235/01
USPC ..... 337/1, 4, 8, 143
See application file for complete search history.

(56) References Cited

U.S. PATENT DOCUMENTS 3,123,692 A 3/1964 Weber
3,406,365 A 10/1968 Lameyre
3,800,259 A 3/1974 Humphreys
4,292,616 A 9/1981 Anderson
4,298,854 A 11/1981 Anderson
5,559,662 A 9/1996 Happ et al.
5,643,012 A 7/1997 Mai et al.
5,969,587 A * 10/1999 Combas ..... H01H 85/545 335/132
6,587,028 B2 7/2003 Mollet et al.
6,650,222 B2 11/2003 Darr et al.
6,717,505 B1 4/2004 Bruchmann
6,727,797 B1 * 4/2004 Bruchmann ..... H01H 9/104 337/194
6,734,580 B1 5/2004 Bruchmann
6,784,783 B2 8/2004 Scoggin et al.
(Continued)

FOREIGN PATENT DOCUMENTS

DE 2913884 10/1980
DE 2913884 A1 * 10/1980 ..... H01H 21/165
EP 319606 4/1989

*Primary Examiner* — Anatoly Vortman
(74) *Attorney, Agent, or Firm* — Brian S. Steinberger; Law Offices of Brian S. Steinberger, P.A.

(57) ABSTRACT

Electrical switches with pivotable toggle portions having replaceable fuses mounted in the toggle portions, and a removable cover/boot protecting the fuse. The electrical switches can have an activation component that closes and opens contact points or a single contact point within switch housing. The activation component can include a front end and a rear end. The rear end can be within the switch housing and the front end can protrude from the switch housing. The front end of the activation component can include a fuse slot. A fuse may be placed in the fuse slot and removed from the fuse slot. A rubber cover or boot, and the like can be removably attachable to the outside of the fuse slot to protect a fuse within the fuse slot. Flush mount and surface mount panels can be used with the electrical switches having replaceable fuses.

19 Claims, 24 Drawing Sheets

(56) References Cited

U.S. PATENT DOCUMENTS

| | | | | |
|---|---|---|---|---|
| 6,853,289 | B2 | 2/2005 | Scoggin | |
| 7,019,612 | B2 | 3/2006 | Lin | |
| 7,474,194 | B2 * | 1/2009 | Darr | H01H 9/104 337/59 |
| 7,495,540 | B2 | 2/2009 | Darr et al. | |
| 7,561,017 | B2 | 7/2009 | Darr et al. | |
| 8,310,333 | B2 * | 11/2012 | Ventura | H01H 9/104 337/187 |
| 8,419,475 | B2 * | 4/2013 | von zur Muehlen | H01H 85/202 439/620.26 |
| 8,766,761 | B2 | 7/2014 | Schwabenland | |
| 9,136,083 | B2 * | 9/2015 | Brakefield | H01R 13/648 |

* cited by examiner

FIG. 1
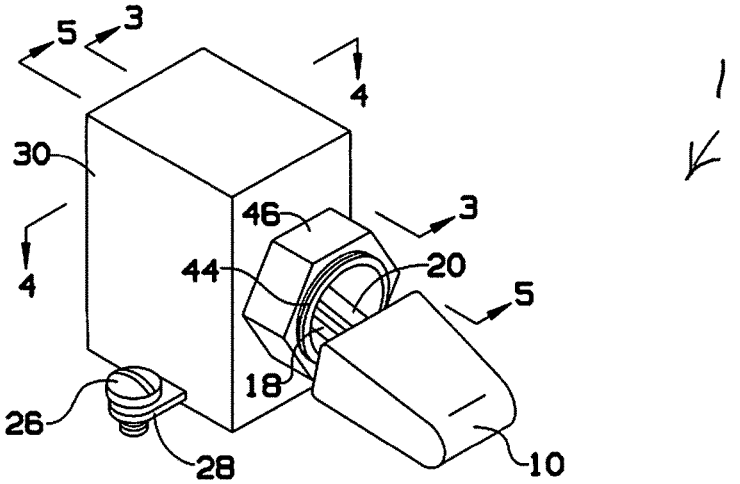
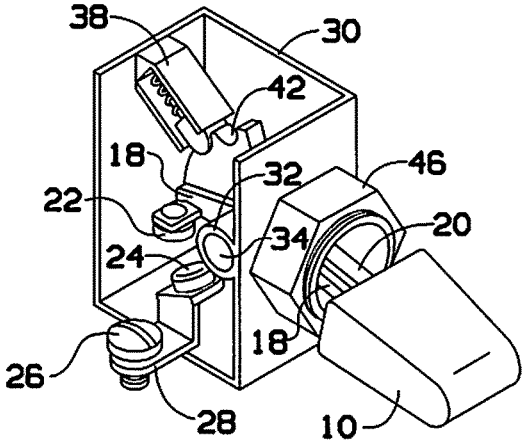
FIG.2
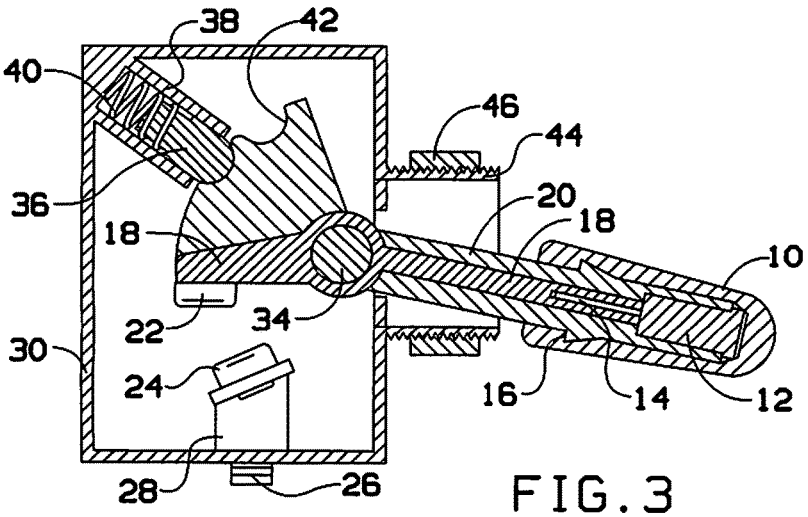
FIG.3

FIG. 17A
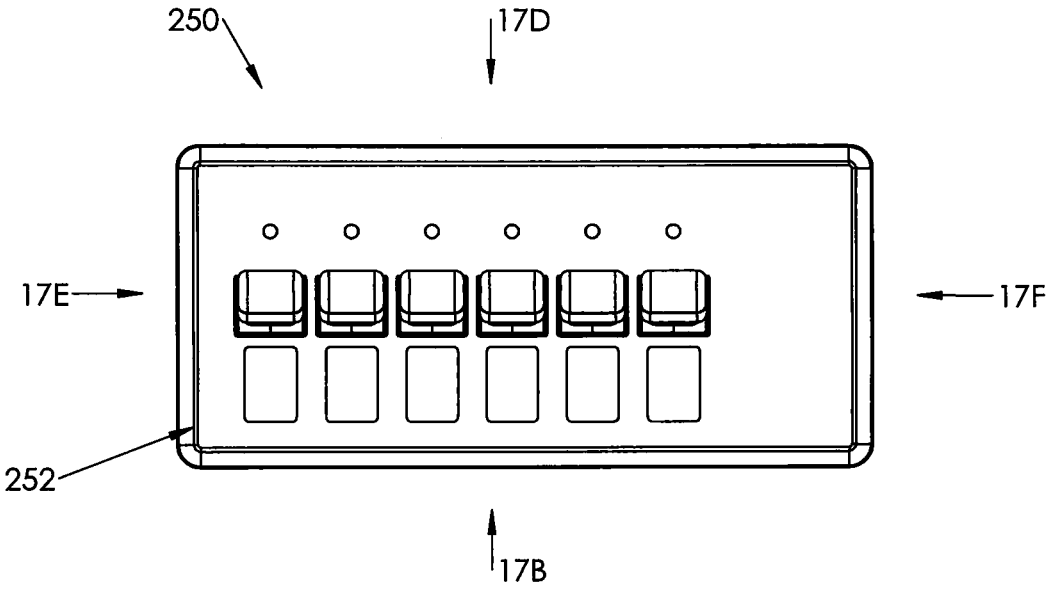
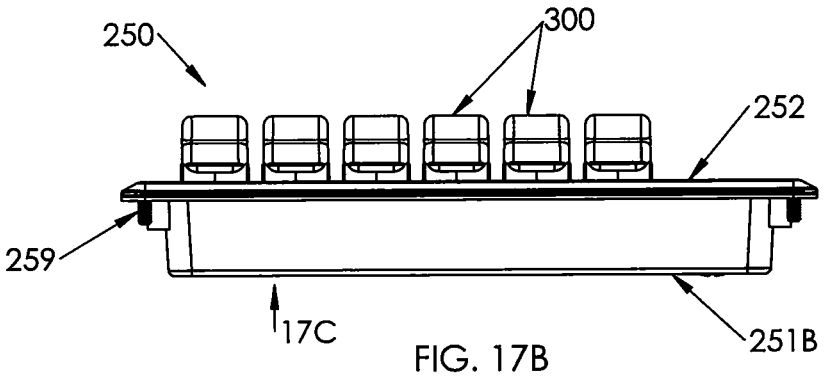
FIG. 17B

FIG. 21A
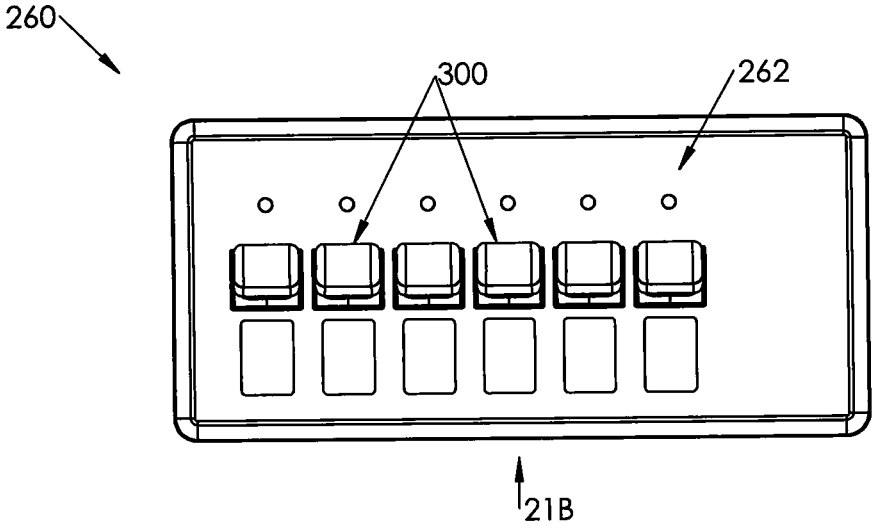
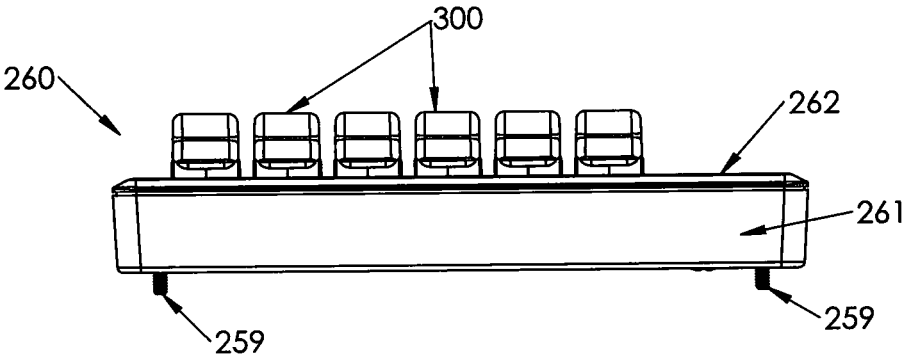
FIG. 21B

ELECTRICAL SWITCH WITH BUILT IN FUSE IMPROVEMENT

CROSS REFERENCE TO RELATED APPLICATION

This application is a Continuation-In-Part of U.S. patent application Ser. No. 13/961,930 filed Aug. 8, 2013, now U.S. Pat. No. 9,263,211, the entire disclosure of which is incorporated by reference in its' entirety.

FIELD OF INVENTION

This invention relates to electrical switches, and in particular to electrical switches, switch panels, devices, apparatus, systems and methods with a changeable fuse in a handle portion.

BACKGROUND OF THE INVENTION

Currently, toggle switches, momentary switches, or thermal circuit breakers are used. A switch is an electrical component that can break an electrical circuit, interrupting the current or diverting it from one conductor to another. Most switch applications are automotive or marine. The switches require a fuse to work. If a failure occurs typically a panel has to be opened to troubleshoot the components. This can be very difficult to accomplish, especially in a marine application.

Typically, thermal breakers can be used for marine application. Thermal breakers tend to be large and do not require fuses. However, it is difficult to pinpoint whether a failure is caused by a faulty thermal breaker or some other anomaly on the circuit. Further, thermal breakers have only one amp setting, which means that if the electrical load is changed, the breaker must be changed as well, which is costly.

Attempts have been made over the years to try to incorporate fuses into a switch. U.S. Pat. No. 3,123,692 to Weber shows and describes a fused switch. However, this fuse is difficult to replace. since it requires the fuse slide through a longitudinal slot in the base of the switch, where the fuse can easily fall out, and become easily lost inside of a bracket or panel box, and the like. As such, this switch would not be practical for use in different applications, such as but not limited to marine applications and the like.

Breakers and switches are bulky, expensive, and difficult to install and troubleshoot while on a vehicle or vessel.

As can be seen, there is a need for an easy to use a compact switch with a built in circuit protection, such as a fuse.

SUMMARY OF THE INVENTION

In an aspect of the present invention, an electrical switch comprises: a switch housing comprising a plurality of contacts; an activation component having a front end and a rear end, wherein the front end protrudes from the switch housing and comprises a fuse slot formed to receive a fuse and the rear end leads into the electrical switch; a lead connected to the fuse slot and running into the switch housing and connected to at least one of the plurality of contacts, wherein the activation component has a closed position and an open position, wherein when the activation component can be placed in a closed position where at least two contacts are touching, and when the activation component is in the open position the plurality of contacts are separated.

The invention can be used in a variety of applications, such as but not limited to marine applications (boats), recreational vehicles (RVs), automobiles, vans, trucks, industrial generators, and the like.

These and other features, aspects and advantages of the present invention will become better understood with reference to the following drawings, description and claims.

Further objects and advantages of this invention will be apparent from the following detailed description of the presently preferred embodiments which are illustrated schematically in the accompanying drawings.

BRIEF DESCRIPTION OF THE DRAWINGS

First Embodiment

FIG. 1 is a perspective view of the present invention.

FIG. 2 is a perspective view of the present invention, with a top and side of the housing of FIG. 1. removed for clarity.

FIG. 3 is a section view of the present invention, taken along line 3-3 of FIG. 1.

Second Embodiment with One Contact

Figure 4:
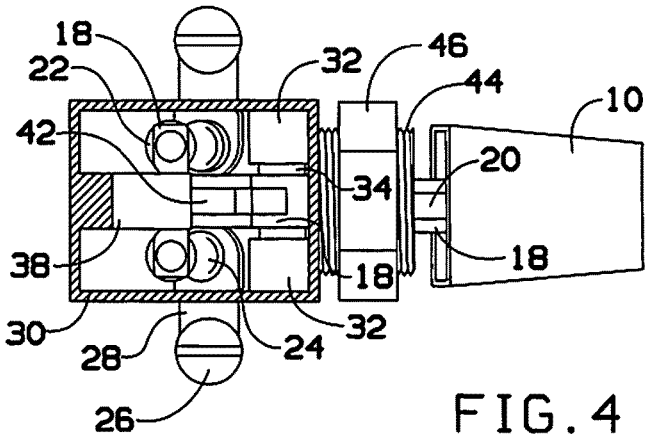
FIG. 4 is a section view of the present invention, taken along line 4-4 of FIG. 1.
Figure 5:
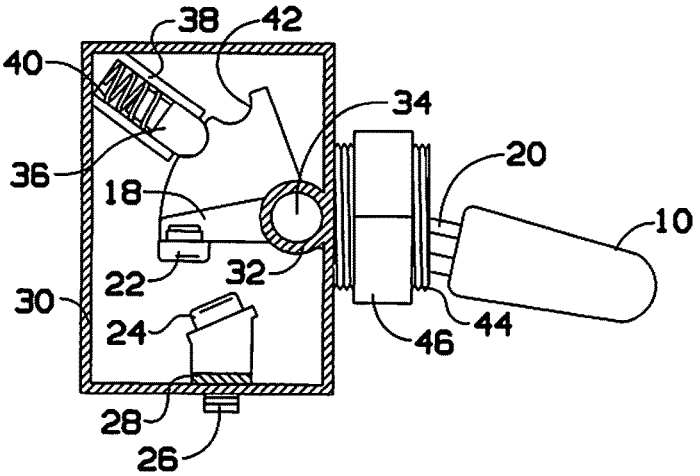
FIG. 5 is a section view of the present invention, taken along line 5-5 of FIG. 1.
Figure 6:
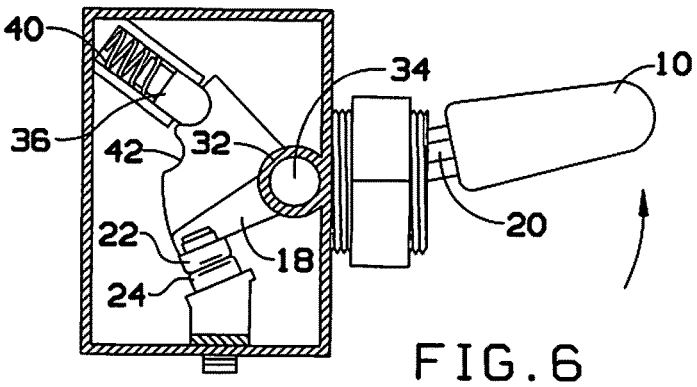
FIG. 6 is a section view of the present invention, illustrating the contacts of FIG. 5 in a closed position.
Figure 7:
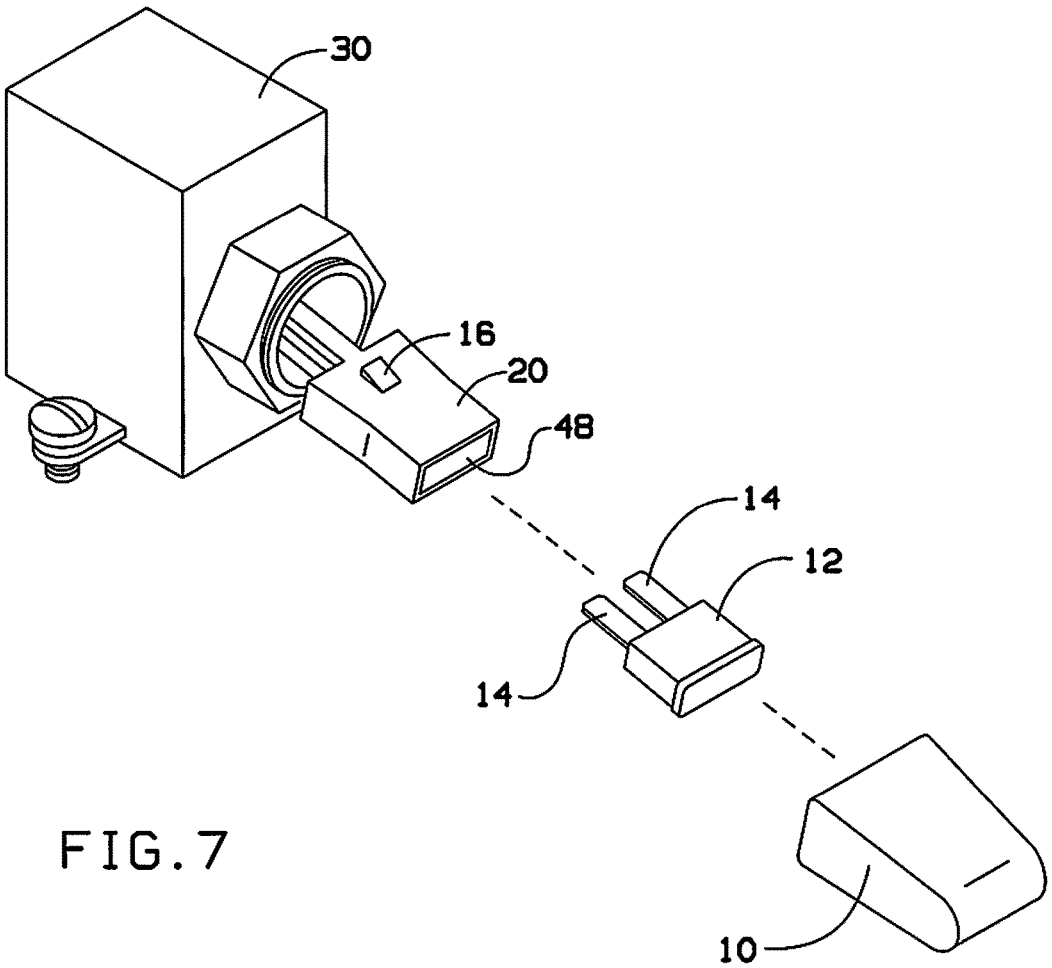
FIG. 7 is an exploded view of the present invention, illustrating the placement of the fuse and boot illustrated in FIG. 3.
Figure 8:
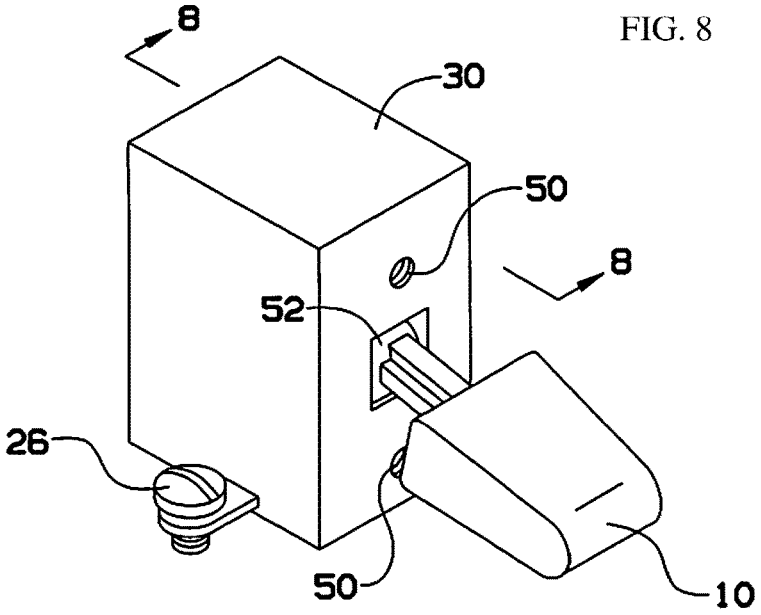
FIG. 8 is a perspective view of an alternate embodiments of the present invention.
Figure 9:
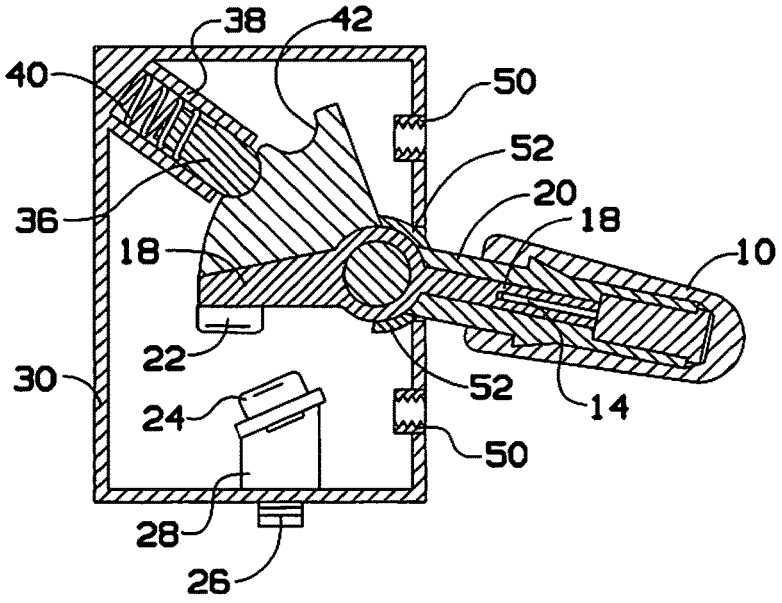
FIG. 9 is a section view of the present invention, taken along line 8-8 in FIG. 7.
Figure 10:
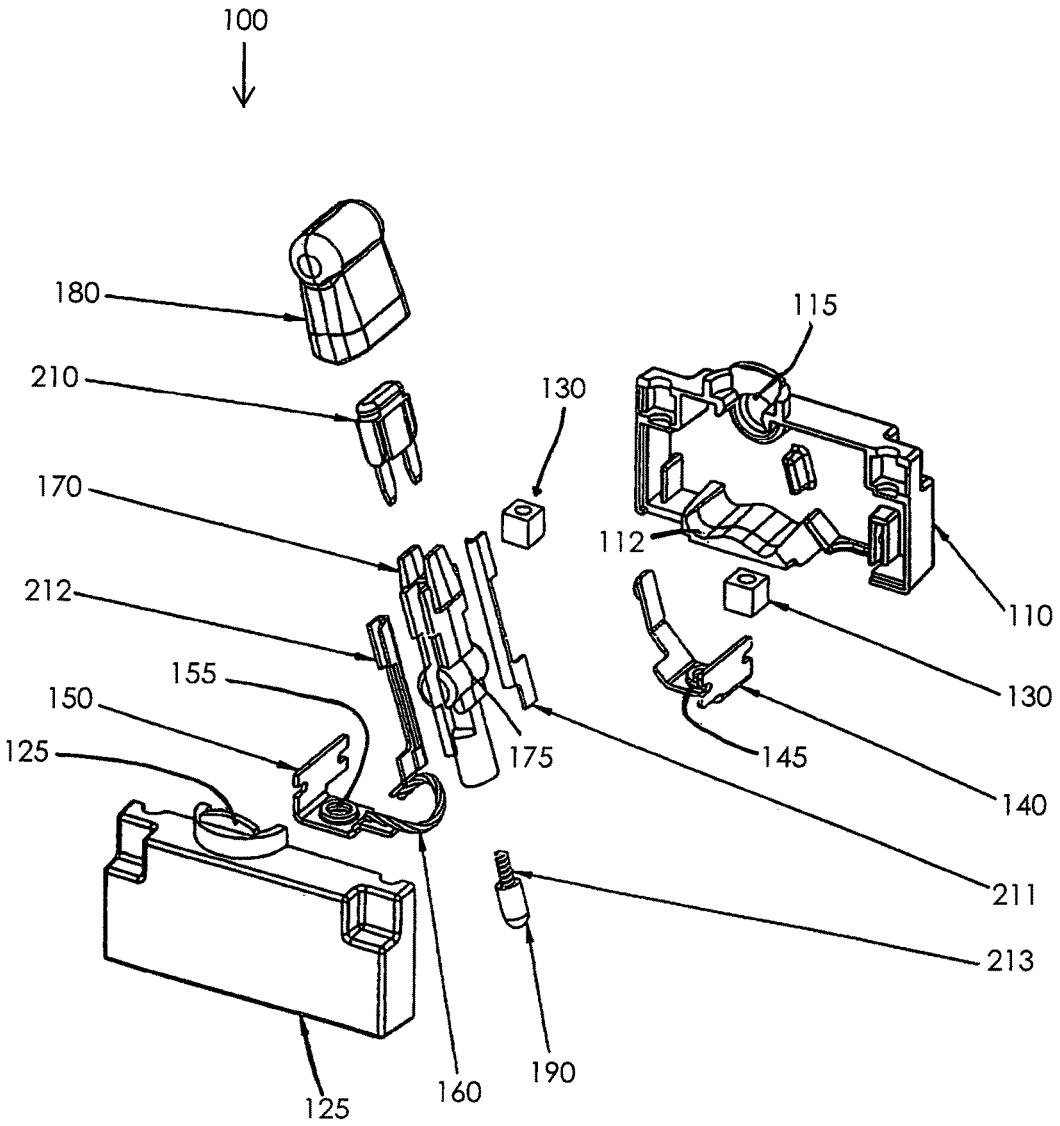

FIG. 10 is an exploded perspective view of the second embodiment fuse switch with single contact.

Figure 11A:
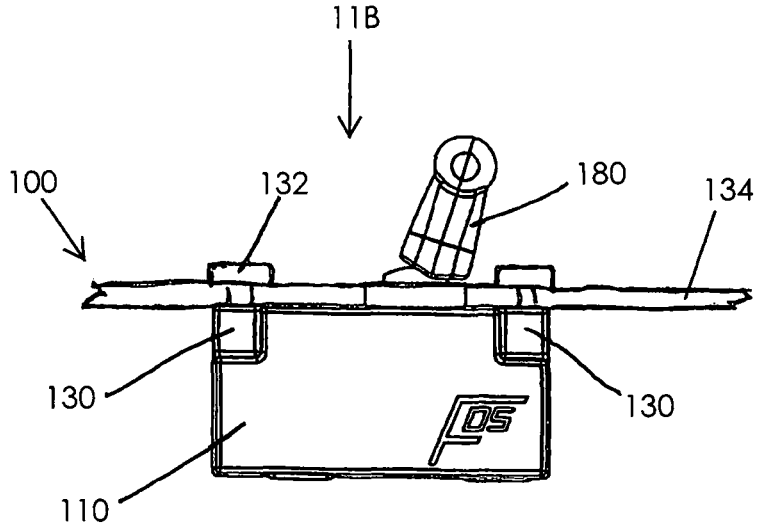

FIG. 11A is a side view of the assembled fuse switch of FIG. 10.

Figure 11B:
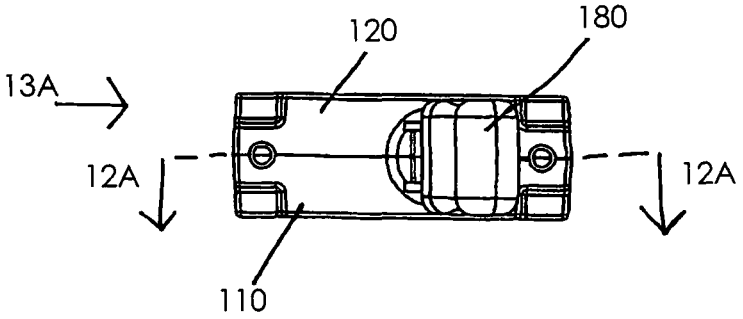

FIG. 11B is a top view of the assembled fuse switch of FIG. 11A along arrow 11B.

Figure 12A:
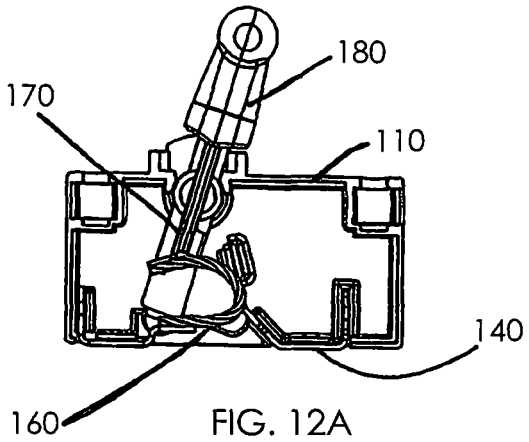

FIG. 12A is a side cross-sectional view of the assembled switch of FIG. 11B along arrows 12A with switch in open position.

Figure 12B:
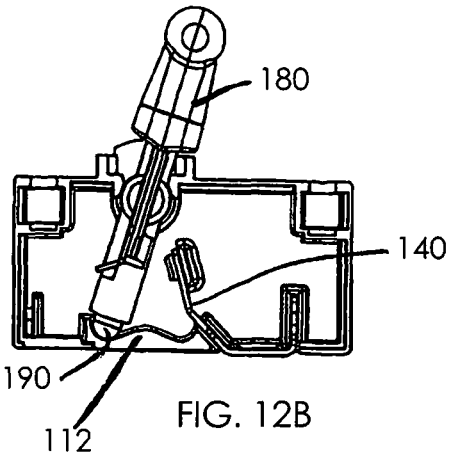

FIG. 12B is another side cross-sectional view of FIG. 12A without the wire bus.

Figure 13A:
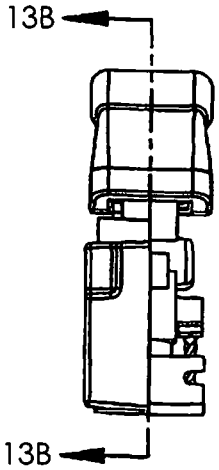

FIG. 13A is a side view of the assembled switch of FIG. 11B along arrow 13A.

Figure 13B:
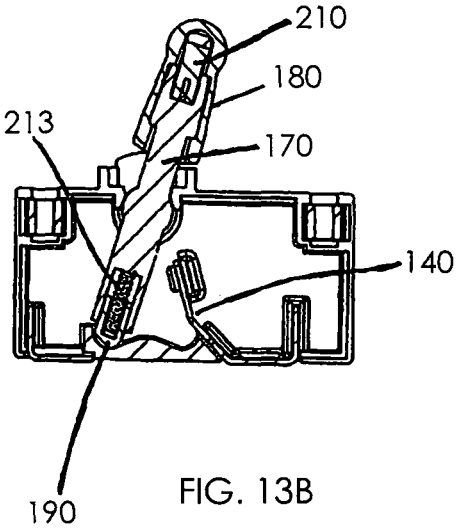

FIG. 13B is a cross-sectional view of the assembled switch of FIG. 13A along arrows 13B.

Figure 14A:
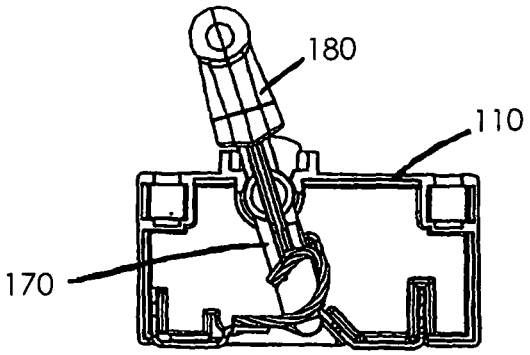

FIG. 14A is another side cross-sectional view of the assembled switch of FIG. 11B arrows 12A with the switch in a closed position.

Figure 14B:
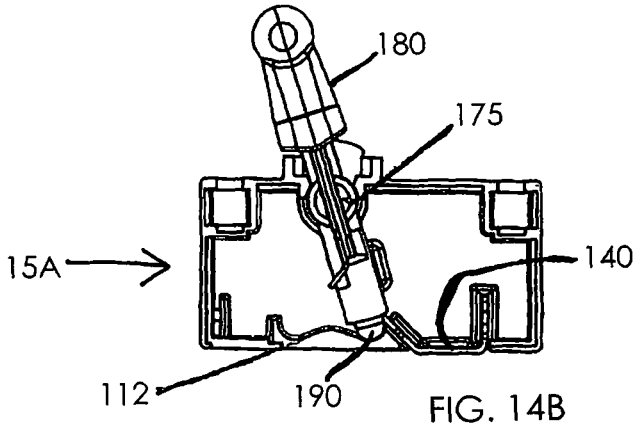

FIG. 14B is another side cross-sectional view of FIG. 14A without the wire bus.

Figure 15A:
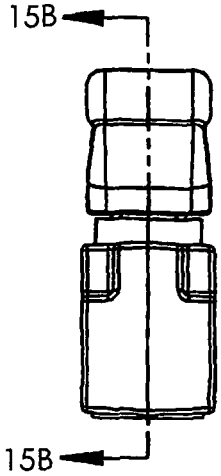

FIG. 15A is a side view of the assembled switch of FIG. 14B along arrow 15A.

Figure 15B:
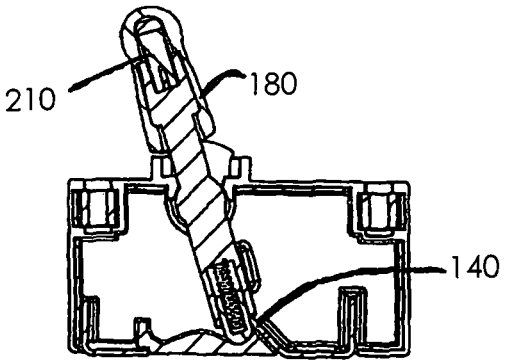

FIG. 15B is a cross-sectional view of the assembled switch of FIG. 15A along arrows 15B.

Third Embodiment Flush Mount Panel for Fuse Switches

Figure 16A:
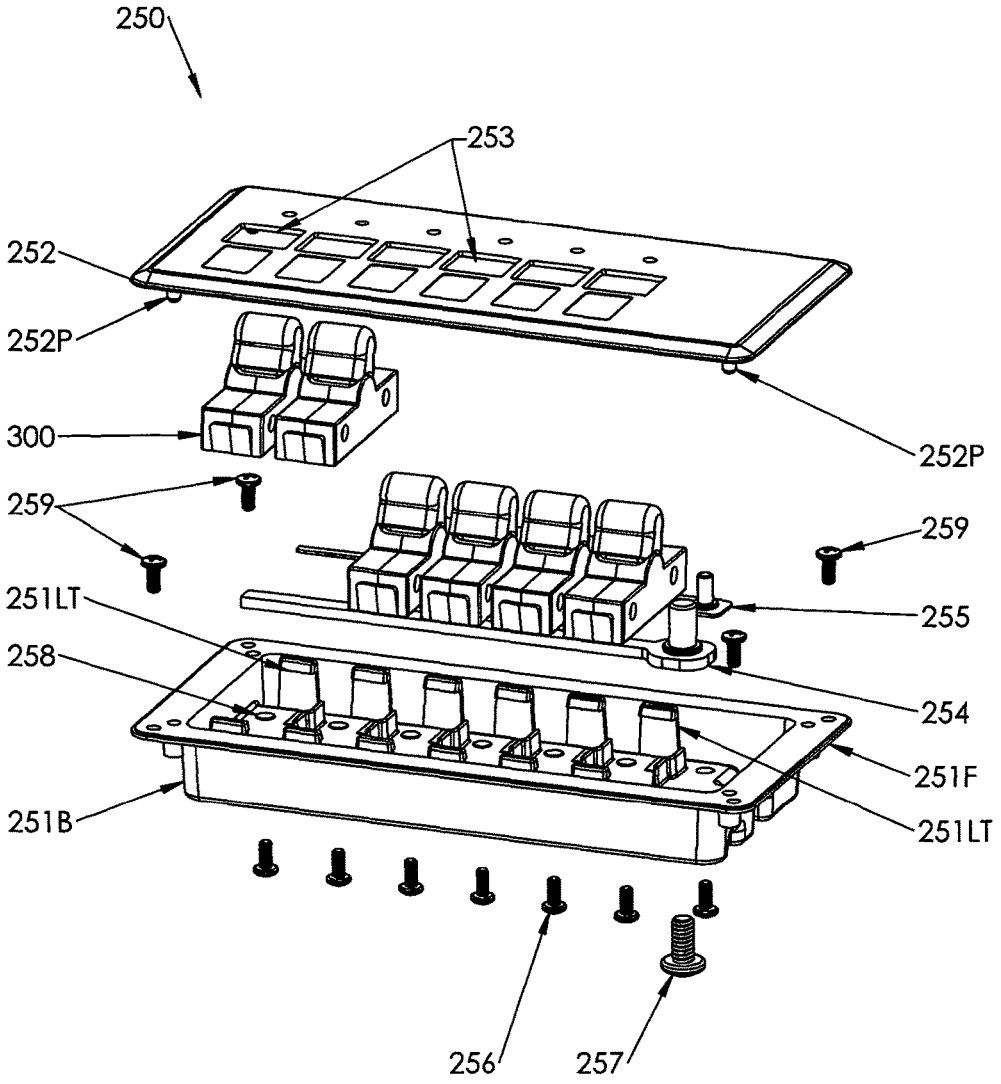

FIG. 16A is an upper exploded perspective view of flush mount panel with fuse switches.

Figure 16B:
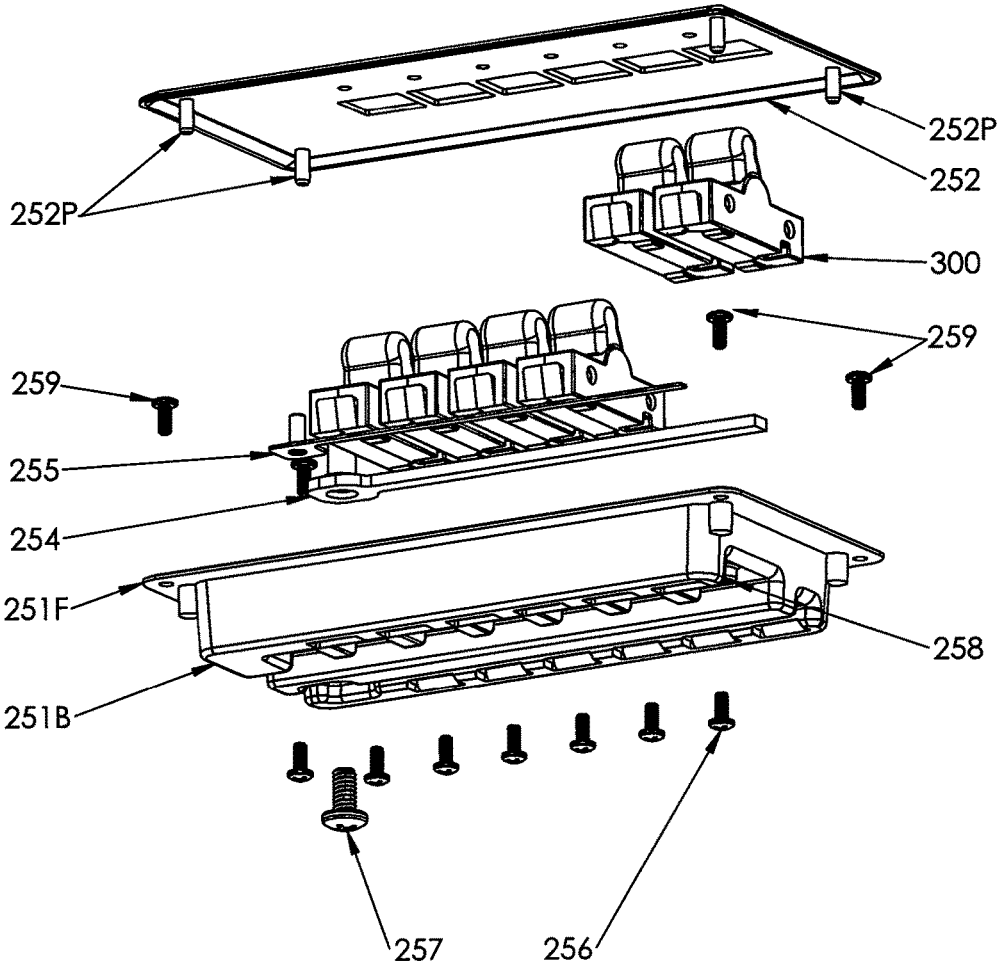

FIG. 16B is a lower exploded perspective view of the flush mount panel embodiment of FIG. 16A.

FIG. 17A is a top view of the assembled flush mount panel of FIGS. 16A-16B.

FIG. 17B is a side view of the assembled panel of FIG. 17A along arrow 17B.

Figure 17C:
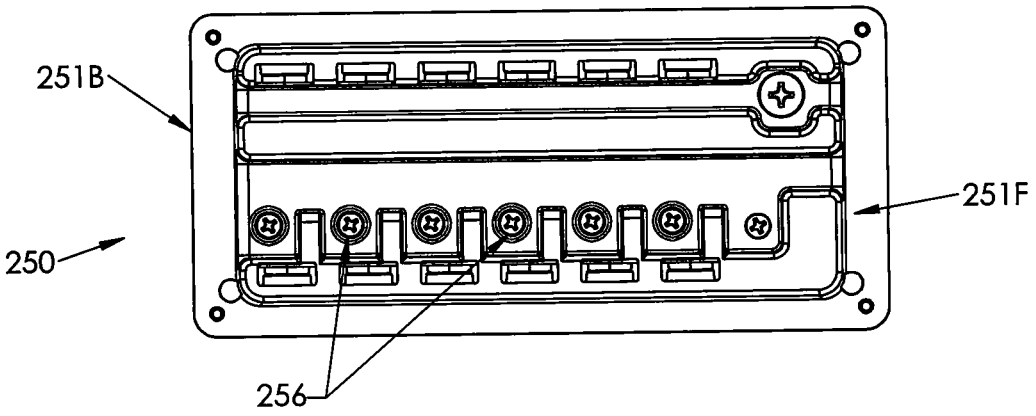

FIG. 17C is a bottom view of the assembled panel of FIG. 17B along arrow 17C.

Figure 17D:
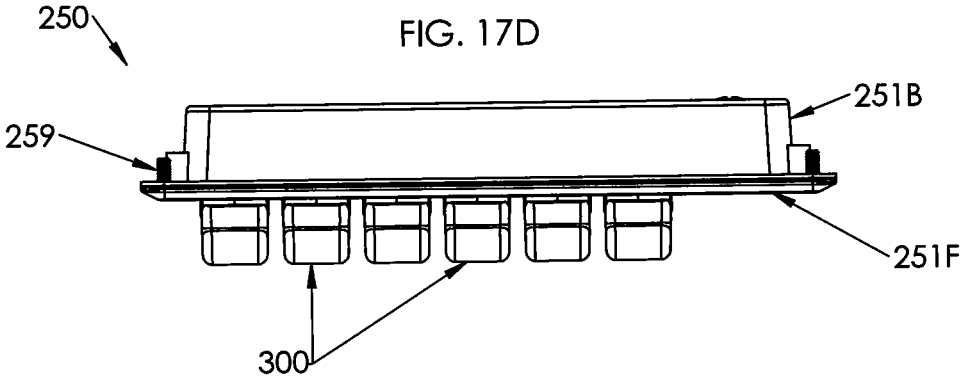

FIG. 17D is a side view of the assembled panel of FIG. 17A along arrows 17D.

Figure 17E:
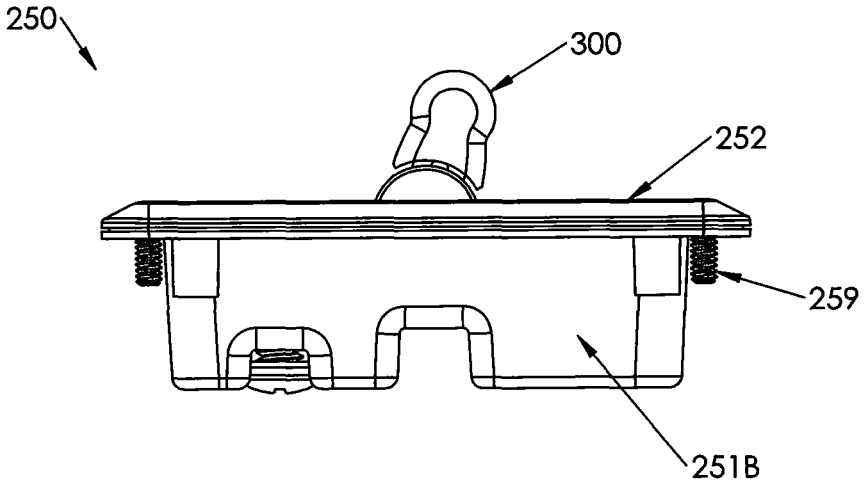

FIG. 17E is a left end view of the assembled flush mount panel of FIG. 17A along arrow 17E.

Figure 17F:
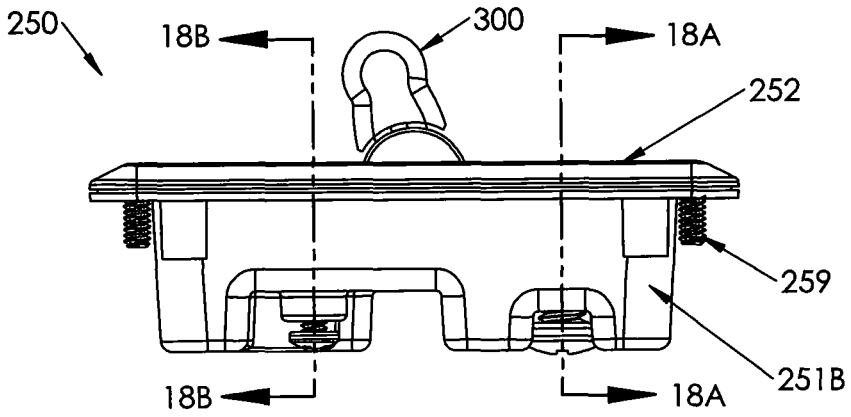
Figure 18A:
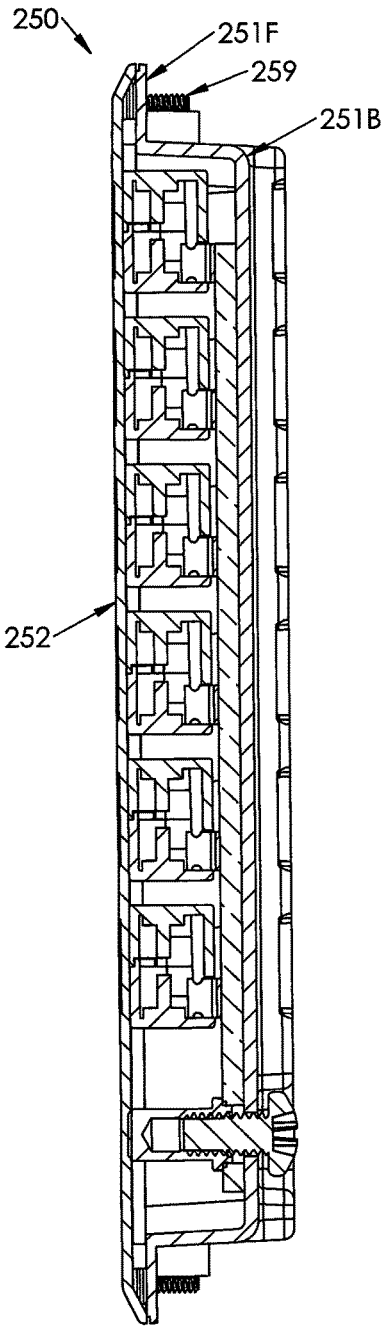

FIG. 17F is a right end view of the assembled flush mount panel of FIG. 17A along arrow 17F FIG. 18A is a cross-sectional view of the assembled flush mount panel of FIG. 17F along arrows 18A.

Figure 18B:
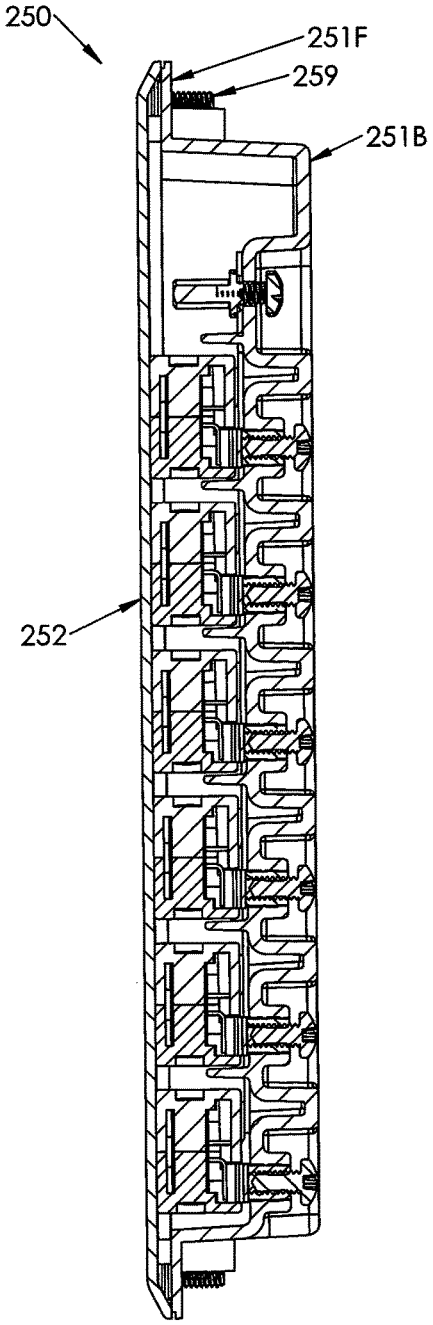

FIG. 18B is a cross-sectional view of the assembled flush mount panel of FIG. 17F along arrows 18B.

Figure 19A:
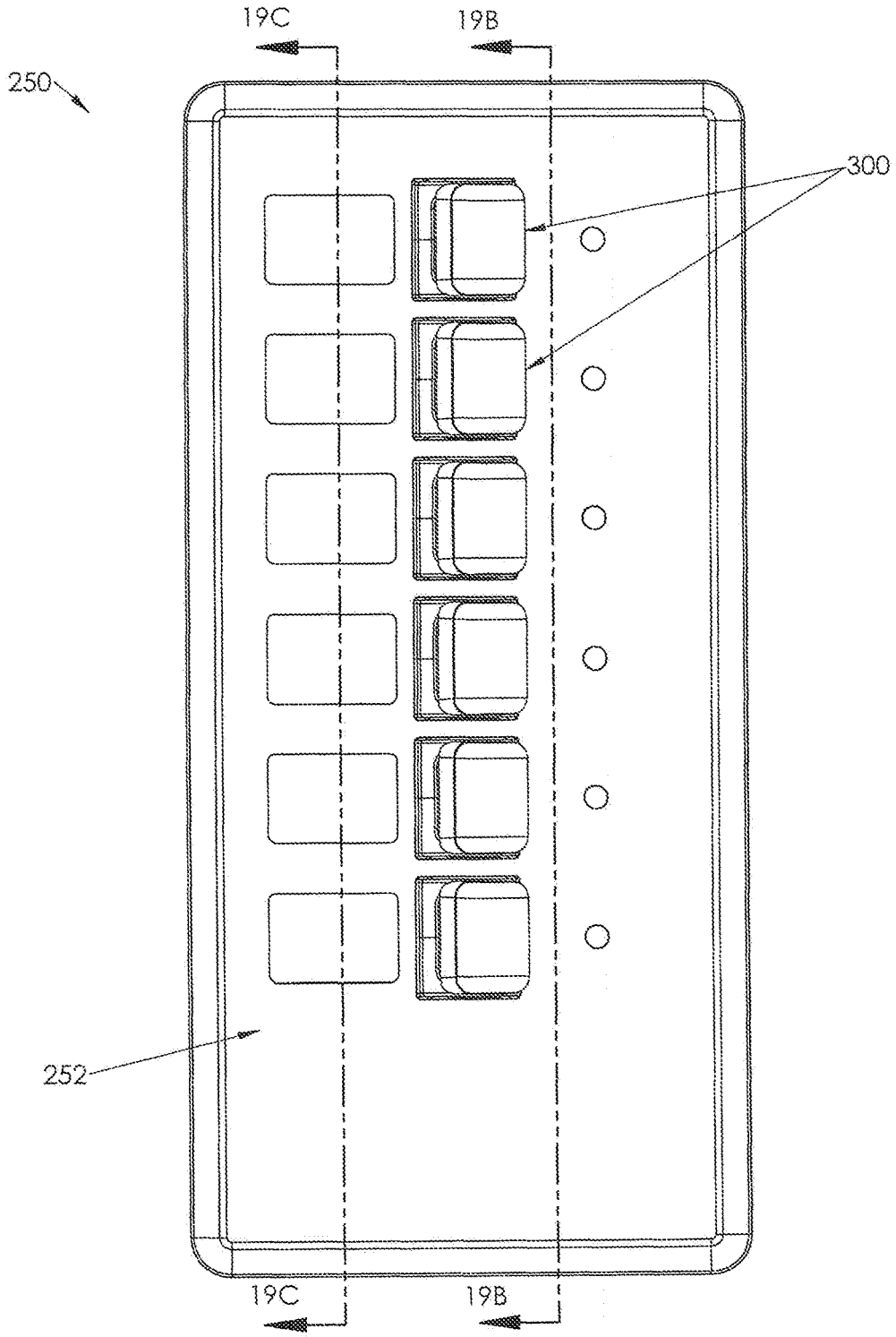

FIG. 19A is another top view of the assembled flush mount panel of FIG. 17A.

Figure 19C:
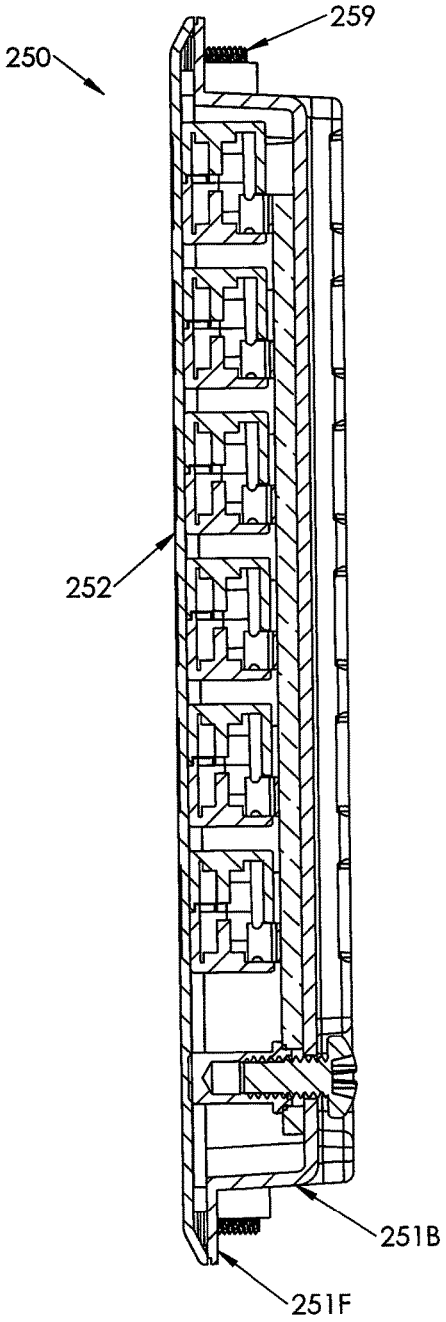
Figure 19B:
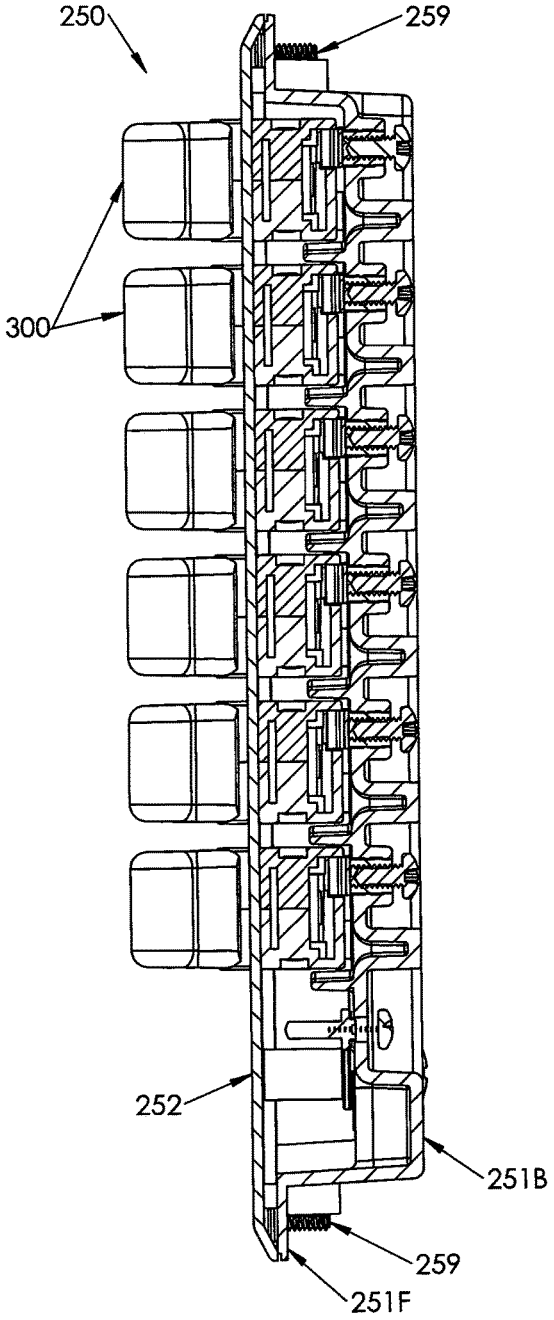

FIG. 19B is a side cross-sectional view of the assembled flush mount panel of FIG. 19A along arrows 19B.

FIG. 19C is a side cross-sectional view of the assembled flush mount panel of FIG. 19A along arrows 19C.

Fourth Embodiment Surface Mount Panels for Fuse Switches

Figure 20:
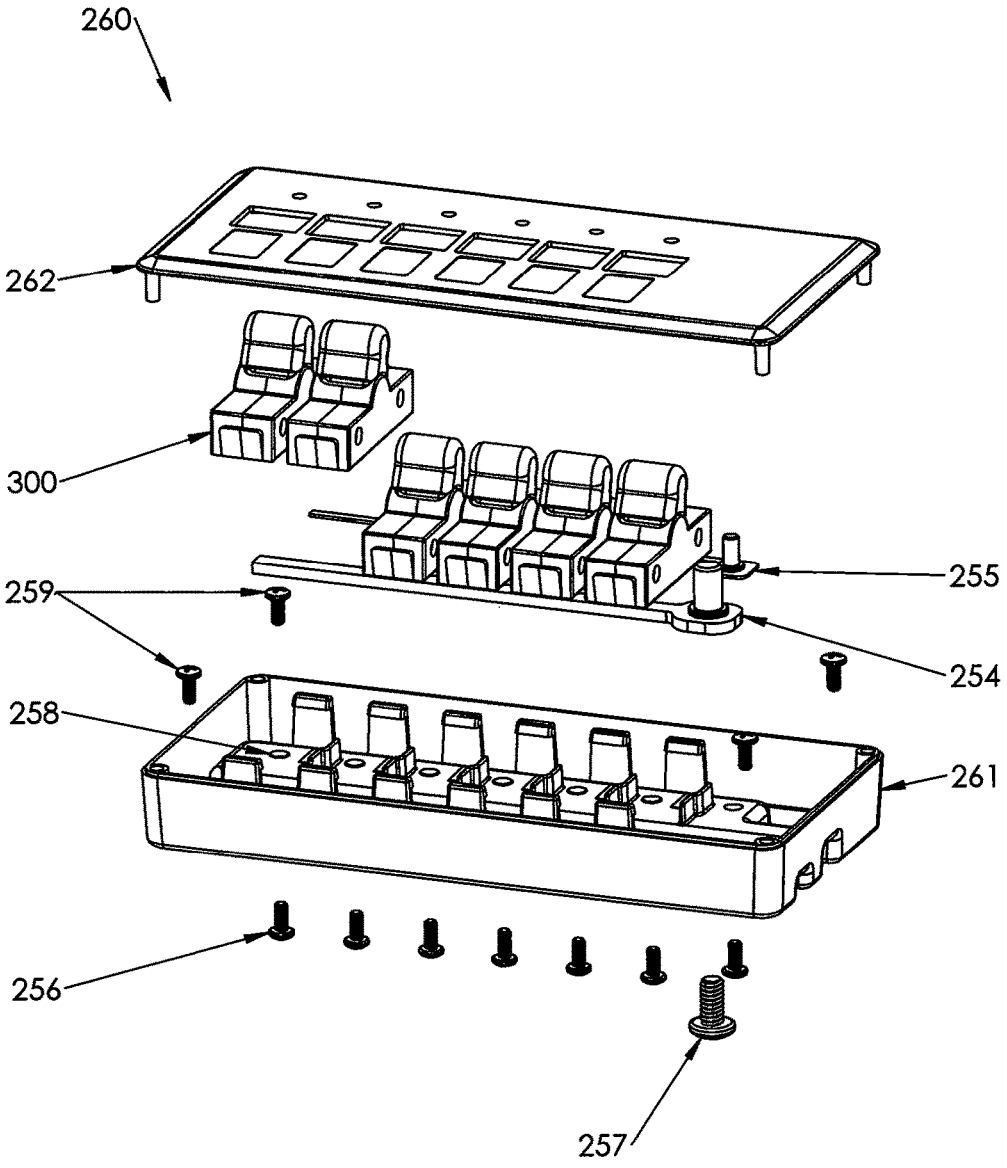

FIG. 20 is an upper exploded perspective view of a surface mount panel embodiment for fuse switches.

FIG. 21A is a top view of the assembled surface mount panel with fuse switches of FIG. 20.

FIG. 21B is a side view of the assembled surface mount pane of FIG. 21A along arrow 21A.

Fifth Embodiment Fuse Switch for Surface and Flush Mount Panels

Figure 22A:
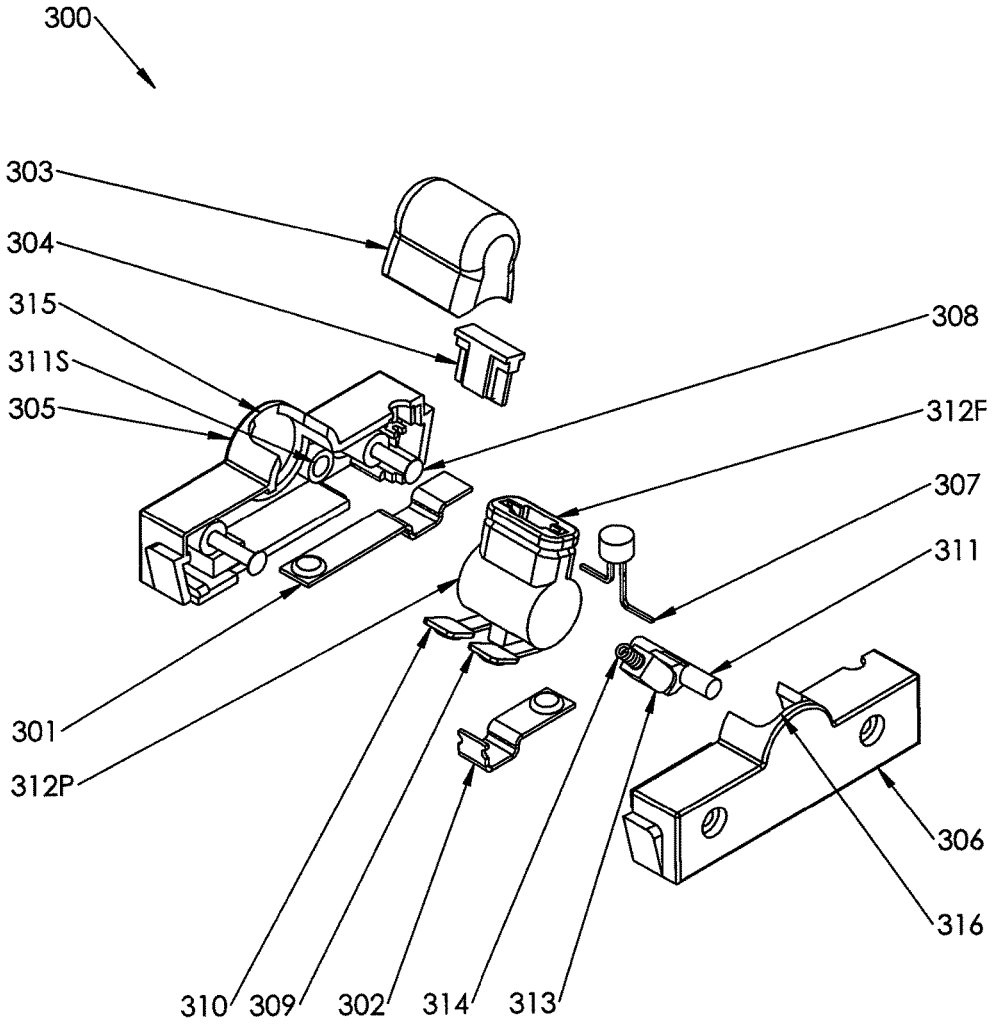

FIG. 22A is an upper perspective exploded view of another fuse switch embodiment with two contacts.

Figure 22B:
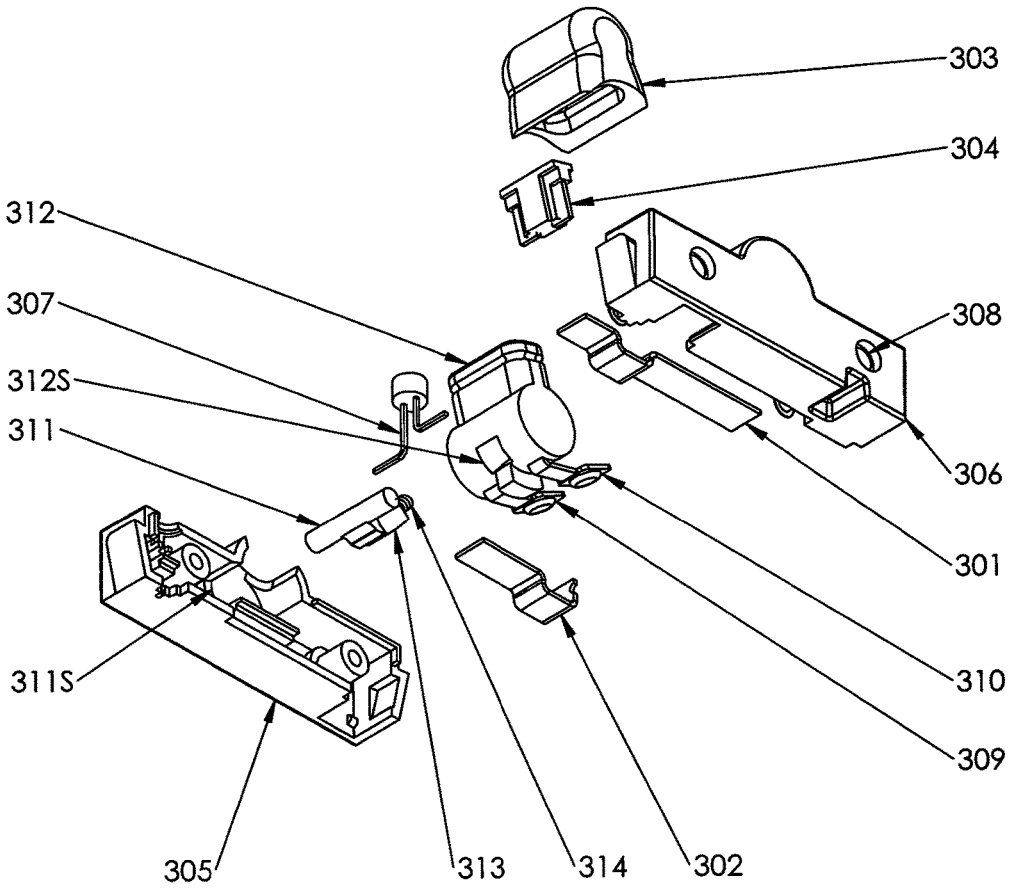

FIG. 22B is a lower perspective exploded view of the another fuse switch embodiment of FIG. 22A.

Figure 23A:
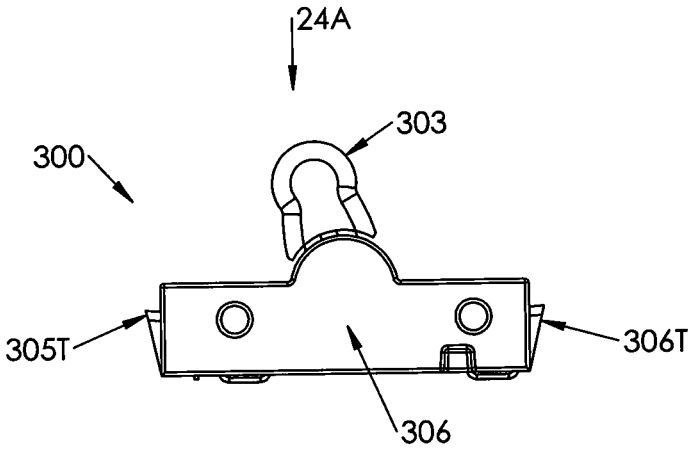

FIG. 23A is a side view of an assembled fuse switch embodiment of FIGS. 22A-22B with the switch in an open position.

Figure 23B:
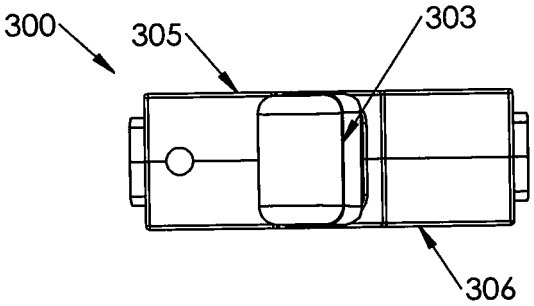

FIG. 23B is a top view of the assembled fuse switch embodiment of FIG. 23A.

Figure 24A:
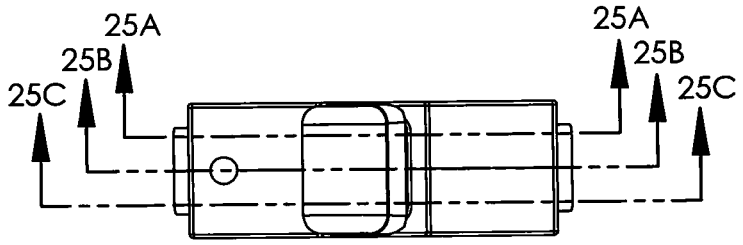

FIG. 24A is a left end view of the assembled fuse switch of FIG. 23B along arrow 24A with the switch in an open position.

Figure 24B:
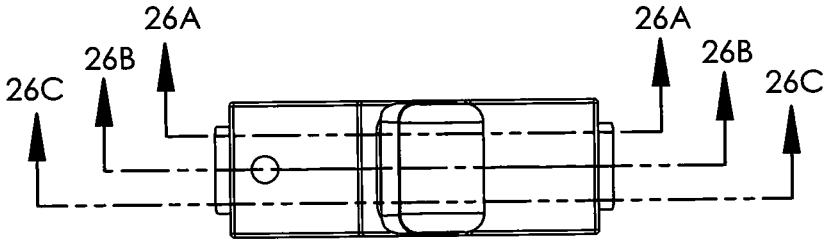

FIG. 24B is another left end view of the assembled fuse switch of FIG. 24A with the switch in a closed position.

Figure 25A:
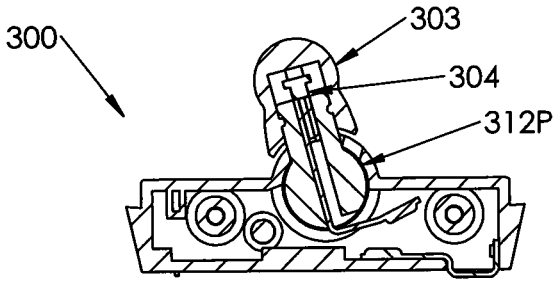

FIG. 25A is a cross-sectional view of the assembled fuse switch in an open position of FIG. 24A along arrows 25A.

Figure 25B:
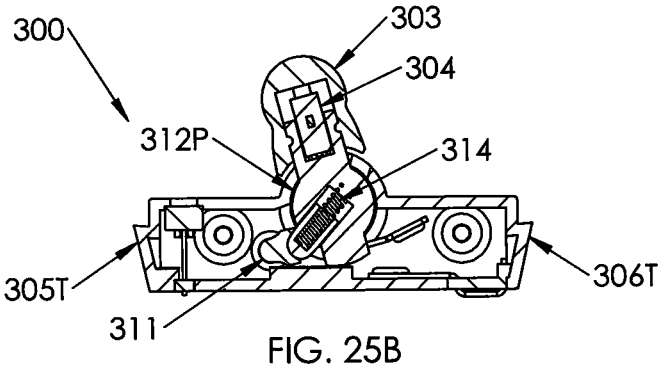

FIG. 25B is a cross-sectional view of the assembled fuse switch in an open position of FIG. 24B along arrows 25B.

Figure 25C:
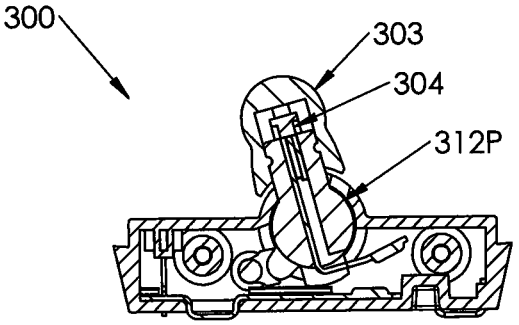

FIG. 25C is a cross-sectional view of the assembled fuse switch in an open position of FIG. 24*b* along arrows 25C.

Figure 26A:
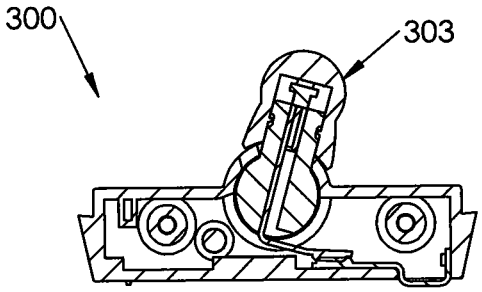

FIG. 26A is a cross-sectional view of the assembled fuse switch in a closed position of FIG. 24B along arrows 25A.

Figure 26B:
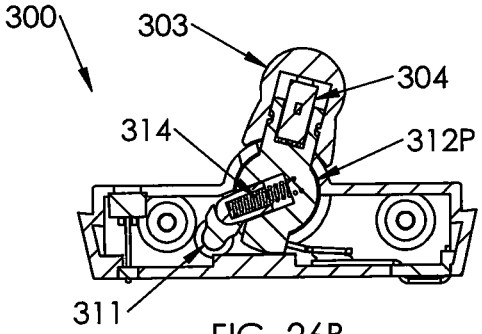

FIG. 26B is a cross-sectional view of the assembled fuse switch in a closed position of FIG. 24B along arrows 25B.

Figure 26C:
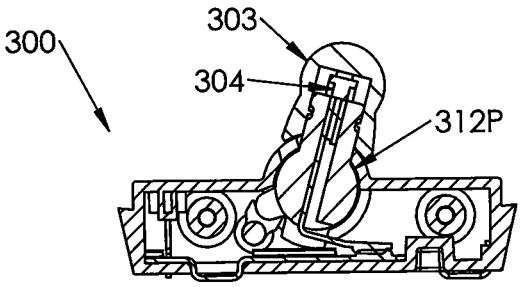

FIG. 26C is a cross-sectional view of the assembled fuse switch in a closed position of FIG. 24B along arrows 25C.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 First embodiment switch with fuse
10 boot
12 fuse
14 fuse contacts
16 locking tab
18 lead
20 toggle handle
22, 24 contacts
26 attachment screw
28 wire leads
30 switch housing
32 pivot bar bearing
34 pivot bar
36 locking tab
38 locking tab chamber
40 spring
42 tab slots
44 threaded portion
48 fuse slot
50 threaded inserts
52 seal
54 activation component
100 Second embodiment Switch with fuse and one contact
110 right housing
112 switch slots/locking cam
115 right rotation socket
120 left housing
125 left rotation socket
130 fastener(s), such as but not limited to square nuts, and the like
132 fastener(s), such as but not limited to screws, and the like.
134 existing panel
140 right bus
145 load screw terminal
150 left bus 2
155 screw panel
160 bus wire, such as copper bus wire
170 rocker (toggle switch)

175 cylindrical mid-portion of rocker
180 switch cover, or boot
190 slider-1
210 fuse
211 fuse bus alt 2
212 fuse bus alt 2
213 spring 1-1
250 flush mount panel embodiment, can be formed from molded plastic
251B flush bucket
251F flush mount flange edges
251S sockets
251LT lock tab catches inside panel clip about locking tabs 305T,306T
252 flush top plate
252P posts for friction fit
253 slots for the toggle switch portions of switches 300
254 main bus
255 minor bus
256 fastener (i.e. screw)
257 fastener (i.e. screw)
258 threaded insert
259 fastener (i.e. screw)
260 surface mount panel embodiment
261 surface bucket with NO flange edges
262 surface top plate
300 fuse switch with two contacts embodiment
301 bus left
302 bus right
303 cover/boot for fuse, part of toggle handle
304 fuse
305 housing left side
305T left locking tab(s)
306 housing right side
306T right locking tab(s)
307 LED (light emitting diode)
308 fastener (i.e. rivets, screws, and the like)
309 rocker bus
310 rocker bus alt.
311 rocker pin
311S left, right rotation sockets
312P rocker pivot (cylindrical midportion), part of toggle handle
312F socket for fuse
312S internal slot in rocker pivot 312P
313 rocker plunger
314 spring
315 left rotation socket
316 right rotation socket Broadly, an embodiment of the present invention provides an electrical switch having an activation component that closes and opens contact points within a switch housing. The activation component can include a front end and a rear end. The rear end can be within the switch housing and the front end can be protruding from the switch housing. The front end of the activation component can include a fuse slot. A fuse can be placed in the fuse slot and removed from the fuse slot. A rubber cover can be removably attachable to the outside of the fuse slot to protect a fuse within the fuse slot, and double as a rocker cover (cover/boot for the toggle handle).

The present invention can include a switch with a standard automotive fuse inserted in the toggle handle of the switch. Therefore, the present invention can eliminate the need for a separate fuse holder or associated wiring. The switch of the present invention can save space and can be simple to install. Further the present invention can be serviced easier than other switches available.

The present invention can be more compact than other switches and fuse combinations or thermal breakers typically found in marine applications. The present invention can reduce the probability of failure due to the reduction of components. The present invention can further facilitate troubleshooting without having to open electrical panels. Further, the amperage capacity can be changed without opening a panel.

Referring to FIGS. 1 through 9, the present invention can include an electrical switch. The electrical switch can include a switch housing 30 with a plurality of contacts 22, 24 within. The electrical switch can further include an activation component 54 having a front end and a rear end. The front end can protrude from the switch housing 30 and can include a fuse slot 48 formed to receive a fuse 12. The rear end of the activation component 54 can lead into the switch housing 30. A lead 18 can connect the fuse slot 48 to at least one of the plurality of contacts 22.

As mentioned above, the fuse 12 can be inserted into the fuse slot 48. The fuse 12 can include fuse contacts 14. When the fuse 12 is inserted into the slot 48, the fuse contacts 14 can make contact with the lead 18. In certain embodiments, a boot 10 can fit over the fuse slot 48 and thereby act as a cover for the fuse 12. In such embodiments, the present invention can include a boot locking tab 16 to secure the boot 10 to the fuse slot 48. The boot 10 of the present invention can be a rubber boot 10 which can be easily removed to access fuse 12.

As illustrated in the Figures, the activation component can include a toggle handles. However, the present invention is not limited to a toggle handles and can include a push button, a lever, and the like. The rear end of the toggle handle 20 can include a pivot bar 34 that pivots along a pivot bar bearing 32 within the housing 30. The rear end of the toggle handle 20 can further include or be connected to tab slots 42 that can include at least a first tab slot 42 and a second tab slot 42. A locking tab 36 can fit within the tab slots 42. The locking tab 36 can be attached to a spring 40 contained within a locking tab chamber 38. The first tab slot 42 and second tab slot 42 can be adjacent to one another. Therefore, when the toggle handle 20 is pivoted along the pivot bar 34, the locking tab 36 can move from the first tab slot 42 to the second tab slot 42 or inversely from the second tab slot 42 to the first tab slot 42.

The activation component 54 can be placed in a closed position and an open position. The closed position can include the contacts 22, 24 touching each other. The open position can include the contacts 22, 24 separated from each other. As illustrated in the Figures, at least one moving contact 22 can be connected to the lead 18 extending from the toggle handle 20. At least one stationary contact 24 can be attached to wire leads 28 which can be attached to a wire attachment screw 26 protruding from the housing 30. When the activation component 54 is in the open position, the locking tab 36 can be within the first tab slot 42 and the moving contact 22 can be separated from the stationary contact 24. When the activation component 54 is in the closed position, the toggle handle 20 can be pivoted along the pivot bar 34 and the locking tab 36 can move from the first tab slot 42 to the second tab slot 42 connecting the moving contact 22 and the stationary contact 24. Thereby, pivoting the toggle handle 20 can lock the activation component 54 into the closed position, creating an electrical connection. Current can then flow toward the wire attachment screws 26.

The present invention can be attached to an electrical panel. In certain embodiments, the housing 30 can attach to the electrical panel by a retaining nut 46 which can be screwed to a threaded portion 44 of the housing 30. In certain embodiments, for marine application, the housing 30 can include threaded inserts 50, so that the housing 30 can be screwed and secured. The present invention can further include a seal 52. The activation component 54 can enter the housing 30 through an opening. The seal 52 can cover the opening and thereby prevent dust, water and the like, from entering the inside of the housing 30. This can be important for marine applications.

A method of using the present invention can include the following. With the present invention installed, if there is an electrical fault the user can remove the rubber cover from the toggle handle to inspect the inserted fuse. The user can check if the fuse is damaged by removing the fuse from the fuse insert. If the fuse is damaged, the fuse can show signs of a melted lead, and the user can be able to easily replace the fuse with a new one. Should the fault be in the electric wiring and not the fuse, the user can check the current flows by removing the rubber boot on the toggle handle and using a meter to check if the switch is getting the correct voltage input. Using the present invention, it is not necessary to unscrew and open the entire electric panel to check for voltage input.

Another advantage of the present invention can include changing the electrical load. For example, a stereo that needs only a 5 amp fuse can be changed to an electric marine toilet that needs a 20 amp fuse. The user can remove the rubber boot from the toggle handle, pull the existing 5 amp fuse out and insert the new 20 amp fuse. Therefore, the user does not need to change the entire switch.

Second Embodiment with One Contact

FIG. 10 is an exploded perspective view of the second embodiment fuse switch 100 with single contact. FIG. 11A is a side view of the assembled fuse switch 100 of FIG. 10. FIG. 11B is a top view of the assembled fuse switch 100 of FIG. 11A along arrow 11B.

FIG. 12A is a side cross-sectional view of the assembled switch 100 of FIG. 11B along arrows 12A with switch in open position. FIG. 12B is another side cross-sectional view of FIG. 12A without the wire bus 160. FIG. 13A is a side view of the assembled switch 100 of FIG. 11B along arrow 13A. FIG. 13B is a cross-sectional view of the assembled switch 100 of FIG. 13A along arrows 13B.

FIG. 14A is another side cross-sectional view of the assembled switch 100 of FIG. 11B arrows 12A with the switch in a closed position. FIG. 14B is another side cross-sectional view of FIG. 14A without the wire bus 160. FIG. 15A is a side view of the assembled switch 100 of FIG. 14B along arrow 15A. FIG. 15B is a cross-sectional view of the assembled switch 100 of FIG. 15A along arrows 15B.

Referring to FIGS. 10-15B, the second embodiment fuse switch 100 can also have a removable fuse 210 in the upper end of a toggle type switch (which can be the rocker 170). The second embodiment 100 can include a right housing 110 which attaches to a left housing 120, with a right rotation socket 115 and left rotation socket 125 that together support a rotatable cylindrical mid-portion 175 of a rocker 170 therebetween. The upper end of the rocker 170 can support a fuse 210 thereon, with a removable switch cover (boot) that can protect the fuse 210. The bottom of the rocker 170 can include a slider 190 with a rounded bottom end that can slide in and out of switch slots 112 in the bottom of right housing 110. The upper end of the slider 190 can include a spring 213, which can keep the rocker 170 in either the open or closed position when rotated about pivot parts 170, 115, 125.

Fastener(s) 130, such as but not limited to a square nut, and the like, can be used to secure a switch 100, behind a basic panel 134 with screws 132. Right bus 14 can be used to make direct connection to load screw terminal 145. Left bus 150 can be used to supply power from a power source (not shown) to switch 100 through screw terminal 155.

Bus wire 160, such as but not limited to a copper bus wire, can be used to make a connection between fuse bus 212 and screw terminal 155. Slider-1 190 can be used to lock rocker 170 in both the open and closed positions. Fuse bus alt 2 211 can be used to make a connection between fuse 210 and load terminal 155. Fuse bus alt 2 212 can be used to make a connection between fuse 210 and an outside power source (not shown), And spring 1-1 213 can be used to allow slider 190 to be flexible when moving in one position and into another over switch slots (locking cam) 112.

Referring to FIGS. 10-15B, the second embodiment 100 can switch between open and closed positions similar to the previous embodiment but instead use one contact. The single contact switch 100 can work by applying power (current) from an outside power source through terminal 150 which can be mechanically attached by a wire 160 to fuse bus 212 which can be connected through fuse 210 through fuse bus 211 that if in a closed position will make contact to right bus 140 and through screw terminal 155 transfer power to a load. The novel switch 100 can provide a more stable switch function, and is more simple than prior art switches and can have a greater lifespan up to approximately 50% or more longer than prior art switches.

Third Embodiment Flush Mount Panel for Fuse Switches

FIG. 16A is an upper exploded perspective view of a flush mount panel 250 with fuse switches 300, such as those described later in reference to FIGS. 23A to 25C. FIG. 16B is a lower exploded perspective view of the flush mount panel embodiment 250 of FIG. 16A.

FIG. 17A is a top view of the assembled flush mount panel 250 of FIGS. 16A-16B. FIG. 17B is a side view of the assembled panel 250 of FIG. 17A along arrow 17B. FIG. 17C is a bottom view of the assembled panel 250 of FIG. 17B along arrow 17C. FIG. 17D is a side view of the assembled panel 250 of FIG. 17A along arrows 17D. FIG. 17E is a left end view of the assembled flush mount panel 250 of FIG. 17A along arrow 17E. FIG. 17F is a right end view of the assembled flush mount panel 250 of FIG. 17A along arrow 17F FIG. 18A is a cross-sectional view of the assembled flush mount panel 250 of FIG. 17F along arrows 18A. FIG. 18B is a cross-sectional view of the assembled flush mount panel 250 of FIG. 17F along arrows 18B. FIG. 19A is another top view of the assembled flush mount panel 250 of FIG. 17A. FIG. 19B is a side cross-sectional view of the assembled flush mount panel 250 of FIG. 19A along arrows 19B. FIG. 19C is a side cross-sectional view of the assembled flush mount panel 250 of FIG. 19A along arrows 19C.

Referring to FIGS. 16A-19C, the flush mount panel 250 can include a bucket 251 with sideways extending flanges 251F, and a flush top plate 252, that can preferably be formed from molded plastic. The Cover top plate 252 can attach to bucket 251B by lower extending molded posts 252P which can be friction pressed into the inside corners inside of bucket 251B, in a tight friction fit. The user can use their fingers or a screw driver to pry off the cover top plate 252 to access and service switch(es) 300 inside the panel 250. An optional O-ring can also be used as needed to seal and offer a tight fit as well between the cover top plate 252 and the bucket 251B.

Although the shown embodiment includes a cover top plate 252 having an aesthetically smooth outer surface, the cover top plate 252 can also be attached to the bucket by other techniques, such as by using screws and the like.

Fasteners 259, such as screws, and the like, can have threaded ends that pass through holes in the flange 251F of the bucket 251B to support against a surface such as a wall, where the bucket 251 can sit inside an opening in the wall so that the panel 250 is flush mounted in place against a wall or other surface.

Additionally, the toggle ends of the switch embodiment 300 can extend out from slots 253 in the flush top plate 252. Main bus 254 installs bucket 251B thereby providing a power supply to one side (positive side) of the switch 300. Minor bus 255 is installed inside the bucket 251B to provide negative current to LED (light emitting diode) 307. Main bus 254 and minor bus 255 can both be installed in bucket 251B by a press fit, where they can snap in place.

Each of the fastener(s) 256 such as screws, and the like, can screw into threaded inserts 258 to attach electrical wires to different loads, such as but not limited to lights, refrigerators, fans, stereos, televisions, electrical outlets and the like. Each of the fastener(s) 257 can attach main bus 254 to supply all the switches 300 with power. Threaded insert 258 can be used to press into bucket 251B to make contact with the load side of switch(es) 300 (shown in FIGS. 23A-26C).

The switch(es) 300 (shown in FIGS. 23A-26C) can be installed into bucket 251B by pressing down the switch(es) 300 into bucket 251B thereby opening locking tab catches 251LT and clicking into position with left and right locking tabs 305T, 306T (shown in FIG. 23A). Thereby, switch(es) 300 can make contact with threaded insert 258 and main bus 254 plus built-in LED 307 will have contact to minor bus 255 for negative connection.

A novel benefit of the flush mount panel 250 is that it only protrudes approximately ⅞ of an inch beyond the surface of the wall, such as a bulkhead, compared to tradition surface mount panels that protrudes up to an approximately 2½ inch depth.

Fault finding can be done from the front of the panel 250. Switches 300 (shown in FIGS. 23A-26C0 can be changed without tools in a few minutes, by a snap fit in and out. In one embodiment left and right locking tabs 305T, 306T, FIG. 23A, on the housing when pushed down can lock under flexible lock tab catches 251LT.

Fourth Embodiment Surface Mount Panels for Fuse Switches

FIG. 20 is an upper exploded perspective view of a surface mount panel embodiment 260 for fuse switches 300, such as those described in reference to FIGS. 22A-25C. FIG. 21A is a top view of the assembled surface mount panel 260 with fuse switches 300 of FIG. 20. FIG. 21B is a side view of the assembled surface mount pane 260 of FIG. 21A along arrow 21A.

The surface top plate 262 can attach to an open end of a surface buck mountable bucket 261 in a similar manner to the previous embodiment 250. Here, the surface mountable bucket 261 has no side extending flanges 251F.

Fasteners 259, such as screws and the like, attach the bottom of the inside of bucket 261 to an exterior surface of a wall, and the like.

The rest of the components in FIGS. 20-21B, can be used and assemble in a similar manner to the previous embodiment described above.

The surface mount panel 260 can be a benefit over prior art panels available today because this panel 260 can be mounted on top of any flat surface and there is no need to cut a hole in the wall or bulk head, that gives the installer endless multiple choices for installing electrical circuits.

Also, similar to the flush mount panel 250, fault finding can be done from the front of the panel 260 and the switch(es) 300 can be changed without tools in a few minutes.

Fifth Embodiment Fuse Switch for Surface and Flush Mount Panels

FIG. 22A is an upper perspective exploded view of another fuse switch embodiment 300 with two contacts. FIG. 22B is a lower perspective exploded view of the another fuse switch embodiment 300 of FIG. 22A. FIG. 23A is a side view of an assembled fuse switch embodiment 300 of FIGS. 22A-22B with the switch 300 in an open position. FIG. 23B is a top view of the assembled fuse switch embodiment 300 of FIG. 23A. FIG. 24A is a left end view of the assembled fuse switch 300 of FIG. 23B along arrow 24A with the switch 300 in an open position.

FIG. 24B is another left end view of the assembled fuse switch of FIG. 24A with the switch 300 in a closed position.

FIG. 25A is a cross-sectional view of the assembled fuse switch 300 in an open position of FIG. 24A along arrows 25A. FIG. 25B is a cross-sectional view of the assembled fuse switch 300 in an open position of FIG. 24B along arrows 25B. FIG. 25C is a cross-sectional view of the assembled fuse switch 300 in an open position of FIG. 24*b* along arrows 25C.

FIG. 26A is a cross-sectional view of the assembled fuse switch 300 in a closed position of FIG. 24B along arrows 25A. FIG. 26B is a cross-sectional view of the assembled fuse switch 300 in a closed position of FIG. 24B along arrows 25B. FIG. 26C is a cross-sectional view of the assembled fuse switch 300 in a closed position of FIG. 24B along arrows 25C.

Referring to FIGS. 22A-26C, the switch embodiment 300 can be used with either the flush mount panel 250 and the surface mount panel 260 shown and described in FIGS. 16A-21B.

Switch 300 can have a housing left side 305 that attaches to a housing right side 306 by fasteners 308, such as but not limited to rivets, screws, and the like. A left rotation socket 315 inside of the housing left side 305 and a right rotation socket 316 inside of the housing right side 306 can allow for a cylindrical mid-portion 312P of a rocker pivot to allow the switch to pivot between an open and closed position. The top of the rocker pivot can have a slot 312F for supporting a replaceable fuse 304 therein. The fuse 304 can be replaced similar to the previous embodiments described above. A cover/boot 303 can protect the fuse 304 when the toggle part of the switch 300 is being used.

Bus left 301 can come into contact with rocker bus alt 310 when switch 300 is in a closed position. Bus right 302 can come into contact with rocker bus 309 when switch 300 is in a closed position.

One side of LED 307 protrudes underneath switch 300 to make contact to minor bus 255 when switch 300 is pressed and locked into position inside of panel(s) 250, 260. The opposite side of LED 307 can have contact to bus left 301 load side. One leg of LED 307 can go to a load side indicating when switch 300 is in a closed position, and the other LED leg can get negative current from minor bus 255.

Rocker bus 309 when the fuse 304 is inserted in fuse socket 312F, will provide contact between rocker bus alt 310 and rocker bus 309. Bus left 301 can function when properly inserted in either panel (flush mount panel 250 or surface mount panel 260) as a contact surface for threaded inserts 258 load side. Bus right 302 will function when properly inserted in either panel (flush mount panel 250 or surface mount panel 260) as a contact surface for a main bus 254.

Rocker pin 311 pivots in left and right rotation sockets 311S on the housing left side 305 and housing right side 306. Rocker pin 311 maximum pivot movement is limited by rocker plunger 313.

Spring 314 can be used to push and lock the rotating rocker pivot 312P in closed and open positions (FIGS. 25A and 26A).

Referring to FIGS. 22A, 22B, and 25A-25C, when the handle (combination of cover 303 and rocker pivot 312P) is in an open position, the rocker plunger 313 is pressed out by spring 314 and locking into an open position.

Referring to FIGS. 22A, 22B, and 26A-26C, when the handle (combination of cover 303 and rocker pivot 312P) is moved towards a closed position it will compress spring 314 and the rocker plunger 313 is pushed in a rocker pivot 312P until switch handle (303, 312P) is all the way in a closed position. In this position, spring 314 will press rocker plunger 313 out and lock rocker pivot 312P in a closed position.

Benefits of switch 300 can include its' smaller size than pre-existing switches found in the market today, as well as be easy to change with no tools. Having the fuse 304 in the handle (303, 312P) makes the switch 300 easy to trouble shoot should the fuse 304 be faulty.

The term "approximately" can be +/−10% of the amount referenced. Additionally, preferred amounts and ranges can include the amounts and ranges referenced without the prefix of being approximately.

It should be understood, of course, that the foregoing relates to exemplary embodiments of the invention and that modifications may be made without departing from the spirit and scope of the invention as set forth in the following claims.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An electrical switch comprising:

a switch housing having at least one contact;

an activation component having a front end and a rear end, wherein the front end includes an elongated toggle handle which protrudes from the switch housing having an upper end and a lower end, the upper end of the elongated toggle handle comprises a single fuse slot having a single top opening and a bottom and closed sides, the single top opening formed to solely receive a fuse which abuts against the bottom of the single fuse slot, with the bottom of the single fuse slot being above the rear end of the elongated toggle handle, and the rear end of the elongated toggle handle leads into the electrical switch;

a pivot for allowing the elongated toggle handle to move between a closed position and an open position relative to the switch housing with the upper end of the elongated toggle handle always protruding out from the switch housing in both the closed position and the open position, the lower end of the elongated toggle handle always remaining within the switch housing in both the closed position and the open position; and a cover having a first position which fits over the single top opening of the fuse slot for covering both the fuse and the single top opening of the fuse slot, and a second position where the cover is removed to provide access to the fuse and the fuse slot.

2. The electrical switch of claim 1, wherein the housing includes:

a left rotation socket and a right rotation socket, wherein a rounded mid-portion of the activation component is pivotally supported by the left rotation socket and the right rotation socket.

3. The electrical switch of claim 2, wherein the rounded mid-portion includes a cylindrical portion having an axes perpendicular to an axis between the front end and the rear end of the activation component.

4. The electrical switch of claim 1, wherein the activation component comprises a pivot bar that pivots along a pivot bar bearing.

5. The electrical switch of claim 1, further comprising:

a spring biased plunger extending below the rear end of the activation component.

6. The electrical switch of claim 5, further comprising:

slots adjacent to each other in the bottom of the housing for allowing the spring biased plunger to hold the activation component in the open position and the closed position.

7. The electrical switch of claim 2, further comprising:

a spring extending upward from a rotatable rocker plunger mounted to a lower inside floor surface inside of the housing.

8. The electrical switch of claim 7, further comprising:

a slot extending into the rounded mid-portion of the activation component.

9. The electrical switch of claim 1, wherein the at least one contact includes:

a single contact in the housing.

10. The electrical switch of claim 1, wherein the at least one contact includes:

two contacts in the housing.

11. The electrical switch of claim 1, further comprising:

a surface mounted panel for mounting the electrical switch therein.

12. The electrical switch of claim 1, further comprising:

a flush mounted panel for mounting the electrical switch therein.

13. An electrical switch comprising:

a switch housing having at least one contact;

an activation component having a front end and a rear end, wherein the front end protrudes from the switch housing and comprises a single fuse slot having a single top opening closed sides and a bottom, the single top opening formed to solely receive a fuse which abuts against the bottom of the single fuse slot, and the bottom of the single fuse slot being above the rear end of the activation component, and the rear end of the activation component leads into the electrical switch;

a pivot portion for allowing the activation component to move between a closed position and an open position relative to the switch housing, with the front end of the activation component always protruding out from the switch housing in both the closed position and the open position, the rear end of the activation component always remains within the switch housing in both the closed position and the open position; and a removable cover for covering one end of the fuse, wherein the activation component comprises a toggle handle connected to the pivot portion that pivots along sockets in the housing, wherein the toggle handle of the activation component is movable between the closed position and the open position.

14. The electrical switch of claim 13, further comprising:

a surface mounted panel for mounting the electrical switch therein.

15. The electrical switch of claim 13, further comprising:

a flush mounted panel for mounting the electrical switch therein.

16. The electrical switch of claim 13, further comprising:

a spring biased plunger extending below the rear end of the activation component.

17. The electrical switch of claim 16, further comprising:

slots adjacent to each other in the bottom of the housing for allowing the spring biased plunger to hold the activation component in the open position and the closed position.

18. The electrical switch of claim 3, further comprising:

a spring extending upward from a rotatable rocker plunger mounted to a lower inside floor surface inside of the housing.

19. The electrical switch of claim 18, further comprising:

a slot extending into the rounded mid-portion of the activation component.

* * * * *